US007385315B2

(12) United States Patent
Steffen

(10) Patent No.: US 7,385,315 B2
(45) Date of Patent: Jun. 10, 2008

(54) FREQUENCY CONVERTER FOR AN IMMERSION VIBRATOR

(75) Inventor: Michael Steffen, Stockdorf (DE)

(73) Assignee: Wacker Construction Equipment AG, Munich (DE)

( * ) Notice: Subject to any disclaimer, the term of this patent is extended or adjusted under 35 U.S.C. 154(b) by 267 days.

(21) Appl. No.: 11/277,077

(22) Filed: Mar. 21, 2006

(65) Prior Publication Data

US 2006/0158038 A1 Jul. 20, 2006

Related U.S. Application Data

(62) Division of application No. 10/182,101, filed on Jul. 22, 2002.

(51) Int. Cl.
*G05F 3/06* (2006.01)

(52) U.S. Cl. ..... 307/151

(58) Field of Classification Search ..... 307/151
See application file for complete search history.

(56) References Cited

U.S. PATENT DOCUMENTS 2,427,111 A 9/1947 Tolmie
3,410,528 A 11/1968 Clark et al.
5,019,767 A 5/1991 Shirai et al.
5,202,612 A 4/1993 Yoshida et al.
5,612,580 A 3/1997 Janonis et al.
6,084,327 A 7/2000 Steffen
6,223,871 B1 5/2001 Steffen

FOREIGN PATENT DOCUMENTS

DE 3901893 A1 8/1989
EP 0964116 A1 12/1999

*Primary Examiner*—Robert L. Deberadinis
(74) *Attorney, Agent, or Firm*—Boyle Fredrickson S.C.

(57) ABSTRACT

The invention relates to a frequency converter for an immersion vibrator, comprising a mobile converter housing, and a converter circuit disposed in said converter housing and adapted to convert an electrical supply voltage to a special voltage. The converter is further provided with a feed line that is mechanically linked with the converter housing and electrically connected to the converter circuit. At the end of said feed line facing away from the converter housing a plug part is disposed. The converter circuit feeds a connector with the special voltage, a plug part of the immersion vibrator being insertable into said connector. A method of operating the immersion vibrator is also disclosed.

11 Claims, 1 Drawing Sheet

FREQUENCY CONVERTER FOR AN IMMERSION VIBRATOR

CROSS REFERENCE TO RELATED APPLICATION

This application is a divisional application of presently co-pending U.S. application Ser. No. 10/182,101, filed Jul. 22, 2002, and entitled "Frequency Converter for an Immersion Vibrator," the entirety of which is incorporated herein by reference.

BACKGROUND OF THE INVENTION

1. Field of the Invention

The invention relates to a frequency converter for an immersion vibrator.

2. Description of the Related Art

Immersion vibrators are used for compressing concrete while it is still liquid. To do this, a vibrator bottle which is part of the immersion vibrator is immersed in the concrete, and an electric motor and an imbalance, which is driven by this electric motor at a high rotation speed, are accommodated in this vibration bottle. In order to achieve the required motor rotation speed and hence compression frequency, the motor must be supplied with a special voltage, whose frequency (for example, 200 Hz) is greater than the mains frequency provided by the public mains system.

It is known for the special voltage to be provided by a special voltage network or by a frequency converter, which is either provided on site in the form of a large stationary unit, or is an integrated component of the immersion vibrator. An immersion vibrator with an integrated frequency converter is known from DE G 92 17 854.5.

CH689598 A5 describes an immersion vibrator in which a converter can be disconnected from a protective sleeve which is fitted with a vibration bottle. The protective sleeve is coupled to the converter via a specially designed electromechanical plug and socket structure, so that not only is it possible to transfer the special voltage, but this also ensures a mechanically firm connection between the protective sleeve and the converter housing. The specific configuration of the electromechanical coupling means that the elements to be coupled must be accurately matched to one another. It is impossible to use components which are not equipped for the specific coupling.

Immersion vibrators with an integrated frequency converter have proven to be excellent in practice. However, as before, immersion vibrators which do not have their own frequency converter and must be fed by an external frequency converter are still used on building sites. These immersion vibrators are primarily distinguished by their cheaper procurement costs. However, on building sites, they require either an appropriate special voltage network at a low voltage level and a high voltage frequency, or a conventional frequency converter, which must be provided where the work is being carried out in the form of a very heavy box. This makes it very difficult to operate such an immersion vibrator.

OBJECTS AND SUMMARY OF THE INVENTION

The invention is based on the object of specifying a frequency converter which also makes it possible for immersion vibrators without their own integrated frequency converters to utilize the advantages of immersion vibrators with their own frequency converter, when desired.

The object is achieved by providing a method of operating a frequency converter in accordance with the present invention.

A frequency converter according to the invention has a mobile converter housing with a converter circuit, and is characterized in that a plug socket is provided which is fed with the special voltage from the converter circuit and into which a plug part of the immersion vibrator can be inserted. According to the invention, it is thus possible to plug the mains plug, which is used as the plug part, of an immersion vibrator which does not have its own frequency converter into the plug socket of the frequency converter, with the plug socket being integrated in the converter housing, or being capable of being connected to the converter housing via a further supply cable. It is thus possible, without incurring any particular additional costs and without having to accept any particular physical complexity, to convert an immersion vibrator without its own frequency converter to an immersion vibrator with a frequency converter.

One advantageous embodiment of the invention is characterized in that the plug socket can be fed with the mains voltage as an alternative to the special voltage, and in that a changeover switch is provided for switching between the special voltage and the mains voltage. The immersion vibrator can thus—as before—also be connected to a special voltage network without the frequency converter having to be removed from it. This has the advantage that the frequency converter cannot be lost during the busy operations on a building site.

In a further advantageous embodiment of the invention a securing device is provided in the region of the plug socket, by means of which the plug part of the immersion vibrator is held in the plug socket. The securing device is thus used for strain relief and allows the operator to pull the frequency converter behind him on the immersion vibrator. For this purpose, the converter housing advantageously has an elongated external shape with minimized transverse dimensions, which makes it considerably easier for the converter housing to slide on the building site, which generally has numerous pieces of reinforcing ironwork. The mobile handling of the frequency converter is additionally improved by the converter housing having a smooth outer skin.

BRIEF DESCRIPTION OF THE DRAWING

These and further advantages and features of the invention will be explained in more detail in the following text using an example and with the assistance of the accompanying FIGURE. The single FIGURE shows a frequency converter according to the invention, with an immersion vibrator connected.

DETAILED DESCRIPTION OF THE PREFERRED EMBODIMENT

Figure 1:
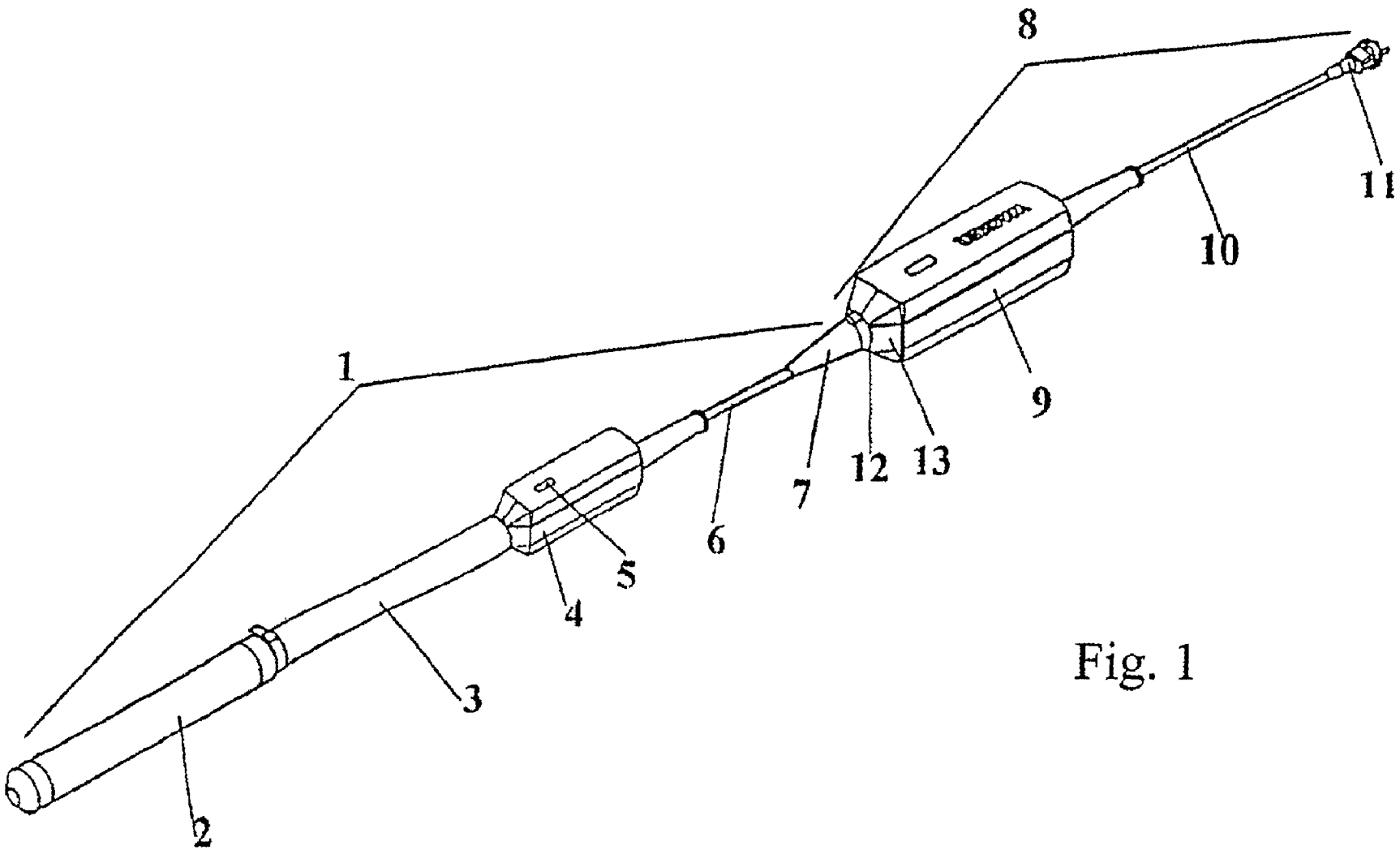

An immersion vibrator 1 which is known per se has a vibration bottle 2, in which an elongated electric motor and an imbalance, which is driven by the electric motor, are accommodated. The vibration bottle 2 is connected to a switch housing 4 via a protective sleeve 3, which may be up to several meters long. The protective sleeve 3 is also used as an operating sleeve, by means of which the vibration bottle 2 is dunked by the operator into the concrete which is to be compressed. A switch 5 is arranged in the switch housing 4, and allows the electric motor in the vibration bottle 2 to be switched on and off. An electrical supply cable 6 passes out of the switch housing 4 and opens into a mains plug 7. Such an immersion vibrator 1, which is known per se, is normally connected by means of the mains plug 7 to a special voltage network provided on the building site or to a stationary frequency converter.

However, according to the invention, a frequency converter 8 is provided, into which the mains plug 7 is inserted.

The frequency converter 8 has a converter housing 9 in which an electronic converter circuit, which is known per se, is accommodated. An additional switch may also be provided, by means of which the power supply can be interrupted.

A supply cable 10 is passed out of the converter housing 9 to a mains plug 11. The mains plug 11 can be inserted into a conventional public mains system, as provided on the building site.

A plug socket 12, into which the mains plug 7 of the immersion vibrator 1 can be inserted, is integrated in the converter housing 9 on the side of the converter housing 9 facing away from the mains plug 11 and the supply cable 10.

The frequency converter 8 draws a conventional mains voltage (230 V or 400 V, 50 Hz) via the mains plug 11, and this is passed via the supply cable 10 to the converter circuit in the converter housing 9. There, the mains voltage is converted to a special voltage, which may be, for example, 42 V at 200 Hz. The special voltage is connected to the plug socket 12, where it can be passed to the immersion vibrator 1 via the mains plug 7.

As an alternative to the embodiment shown in the FIGURE, it is also possible to arrange the plug socket 12 separately from the converter housing 9, and to connect it to the converter housing 9 by means of an additional supply cable.

It is particularly expedient for the mains plug 7 of the immersion vibrator 1 to be held in the plug socket 12 by means of a preferably mechanical securing device. It is thus possible for the operator to pull the immersion vibrator 1 together with the frequency converter 8 behind him using the protective sleeve 3, without the connection between the mains plug 7 and the frequency converter 8 becoming detached.

The converter housing 9 has an elongated slim external shape with minimized transverse dimensions and a smooth outer skin, so that it can be pulled through concrete reinforcement with as little resistance as possible. Oblique end walls 13 on the converter housing 9 further assist the capability to slide.

The electronic design of the converter circuit and the slim shape of the converter housing allow the frequency converter 8 to be handled particularly easily when mobile. The handling capability is further assisted if the converter housing 9 does not have any handle which could adversely affect the sliding capability.

Since the frequency converter 8 together with the immersion vibrator 1 forms a compact unit which can easily be moved by the operator, even conventional immersion vibrators without an integrated frequency converter are provided with the operational advantages which until now have been the exclusive domain of immersion vibrators with an integrated frequency converter.

Another embodiment of the invention which is not illustrated in the FIGURE, allows the frequency converter 8 to not only convert the mains voltage to the special voltage, but also to receive and pass through the special voltage. To do this, a changeover switch is provided on the converter housing 9 for switching between passing the special voltage through the converter circuit, or converting the mains voltage to the special voltage. While the power for producing the special voltage is supplied by the converter circuit, whilst the changeover switch is being operated, it is just passed directly from the supply cable 10 to the plug socket 12, that is to say it just passes through the frequency converter 8. This makes it possible for the combination of the immersion vibrator 1 and the frequency converter 8 to be at least briefly connected to existing special voltage networks as well, without the immersion vibrator 1 needing to be disconnected from the frequency converter 8.

I claim:

1. A method of operating a machine driven by an electric motor electrically connected to receive a special voltage via a main plug, the method comprising the steps of:

receiving a mains supply voltage at a plug part of a portable frequency converter;

receiving an electrical plug part of the machine in an electrical socket of the portable frequency converter;

converting the mains supply voltage to the special voltage via a converter circuit of the portable frequency converter; and communicating the special voltage to the machine via the electrical socket of the portable frequency converter and the electrical plug part of the machine.

2. The method of claim 1, further comprising the steps of:

positioning a changeover switch at a first position so that the converter circuit converts the mains voltage received at the plug part of the frequency converter to the special voltage;

receiving the special voltage at the plug part of the frequency converter; and switching a changeover switch from the first position to a second position in which the converter circuit passes through the special voltage received at the plug part of the frequency converter to the plug socket without modifying the special voltage.

3. The method of claim 1, wherein a frequency level of the special voltage is higher than a frequency level of the mains voltage.

4. The method of claim 1, wherein the machine is an immersion vibrator.

5. The method of claim 1, further comprising the step of:

pulling the machine and the portable housing of the frequency converter using a protective sleeve, wherein the plug part of the machine is connected by a mechanical securing device to the plug socket of the frequency converter.

6. The method of claim 1, wherein the main plug of the machine disconnects from the frequency converter and inserts into a special voltage network for receiving the special voltage.

7. In combination:

an immersion vibrator having a main plug configured to plug into a special voltage network so as to receive a special voltage; and a frequency converter, including:

a mobile converter housing;

a converter circuit that is arranged in the converter housing and that converts an electrical mains voltage to the special voltage, the mains voltage having a frequency level lower than the special voltage;

a plug part;

a plug socket which is fed with the special voltage from the converter circuit, wherein the main plug of the immersion vibrator plugs into the plug socket; and a changeover switch having a first position so as to cause the converter circuit to convert the mains voltage received at the plug part of the frequency converter to the special voltage for communication to the main plug of the immersion vibrator, and a second position so as to cause the converter circuit to pass through the special voltage received at the plug part of the frequency converter to the main plug of the immersion vibrator without modifying the special voltage.

8. The combination as claimed in claim 7, wherein the frequency converter further comprises a securing device in the region of the plug socket, via which the plug part of the immersion vibrator is held in the plug socket.

9. The combination as claimed in claim 7, wherein the converter housing has an elongated external shape with minimized transverse dimensions configured to withstand immersion in a liquid concrete.

10. The combination as claimed in claim 7, wherein the converter housing has a smooth outer skin, and allows mobile handling of the frequency converter.

11. The combination as claimed in claim 7, wherein the plug socket is connected to the housing via a supply cable.

* * * * *